United States Patent [19]

Enomoto et al.

[11] 4,276,893

[45] Jul. 7, 1981

[54] COMPACT

[76] Inventors: Seikichiro Enomoto, 40, Arisugawa machi, Sagano, Sakyo-ku, Kyoto; Yoshiharu Hatakeyama, 5-29-10, Tachibana, Sumida-ku, Tokyo, both of Japan

[21] Appl. No.: 44,222

[22] Filed: May 31, 1979

[30] Foreign Application Priority Data

Apr. 20, 1979 [JP] Japan ..... 54-52020[U]

[51] Int. Cl.[3] ..... A45D 33/00

[52] U.S. Cl. ..... 132/83 R

[58] Field of Search ..... 132/83

[56] References Cited

U.S. PATENT DOCUMENTS

| | | | |
|---|---|---|---|
| 1,446,779 | 2/1923 | Abrahams | 132/83 R |
| 1,749,656 | 3/1930 | Zell | 132/83 R |
| 3,522,963 | 8/1970 | Farnden | 292/83 |

*Primary Examiner*—G. E. McNeill

*Attorney, Agent, or Firm*—Fleit & Jacobson

[57] ABSTRACT

This invention relates to a compact which is easily capable of opening or closing together with keeping cosmetics inside thereof.

More particularly, it relates to a compact wherein a slide hole is perforated at an opening portion of said case body and a slide member having a taper on the upper side of the head is inserted slidably through said slide hole and is allowed to push up a lid of said body using said taper, thereby being capable of disengaging the mesh of a hook of said body with a hook of said lid.

2 Claims, 2 Drawing Figures

COMPACT

BACKGROUND OF THE INVENTION

The conventional compact is provided with protruded parts to be latched with each other in both said lid and said case body respectively.

Accordingly, there exists such defects as follows: In the case of opening, a considerable large force is required because of the large rigidity at the opening portion, and troubles often occur because of the complicated constructions of the elasp part.

Especially, though the conventional insertion at the elasp part is firm at first, it becomes weak during the use of long time, whereby there exists such defects as taking much times in opening or closing the lid, opening without reason in time of no use, drying of the stored cosmetics, powder leakage and the like.

DETAILED DESCRIPTION OF THE DRAWINGS

Figure 1:
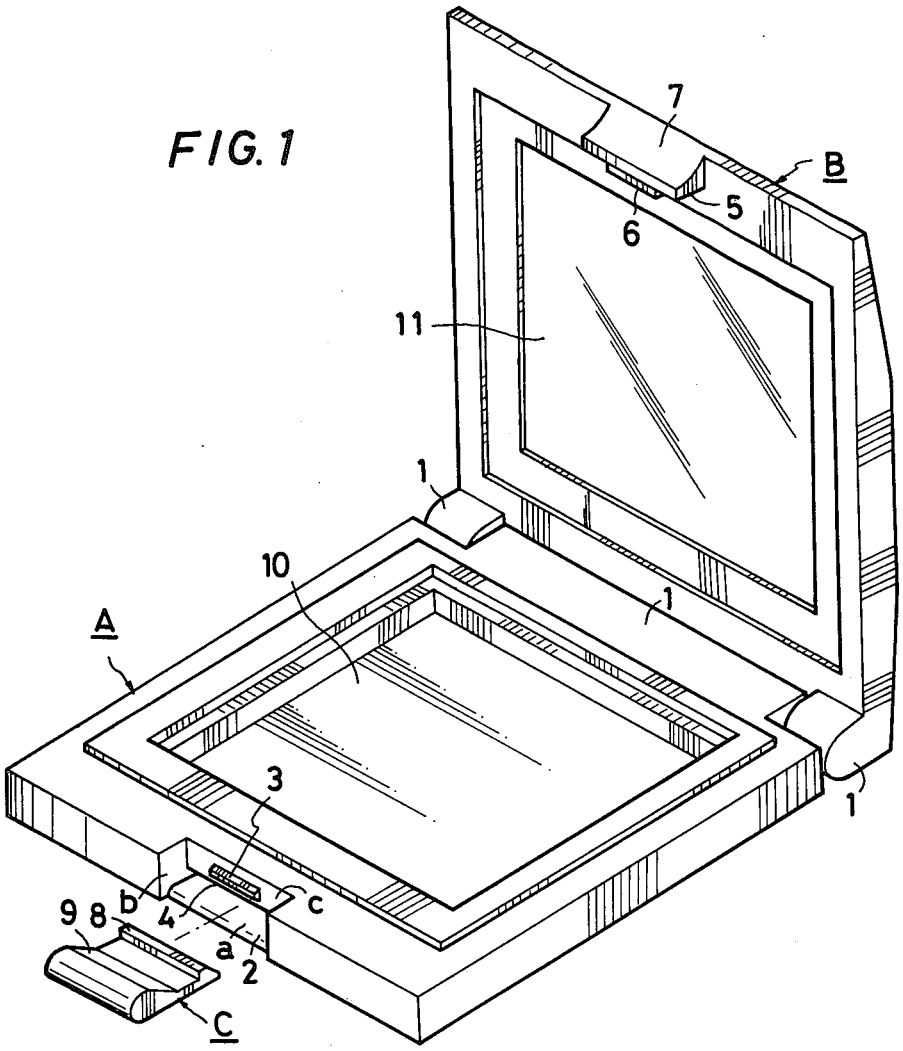
FIG. 1 is a perspective view of the compact which shows the opening condition.
Figure 2:
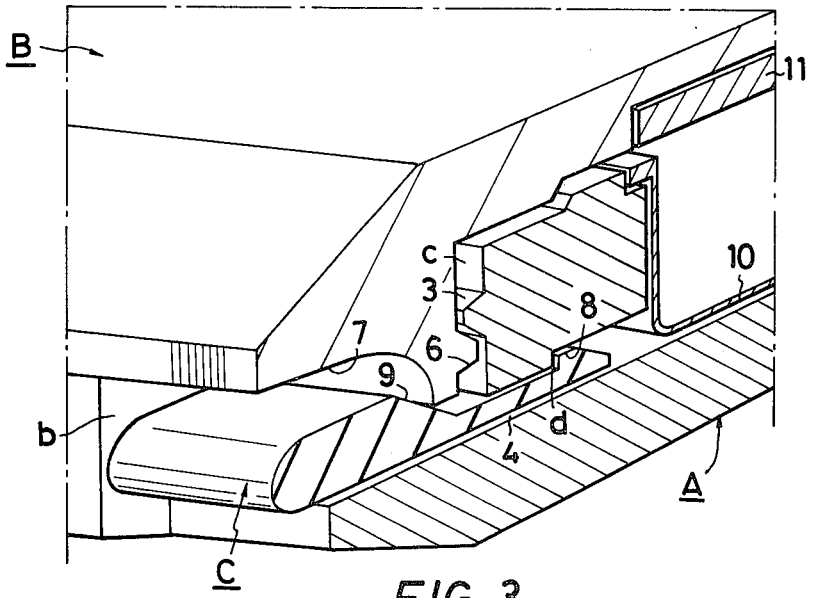
FIG. 2 is a sectional perspective view which shows an opening part of the compact in closed condition.
Figure 3:
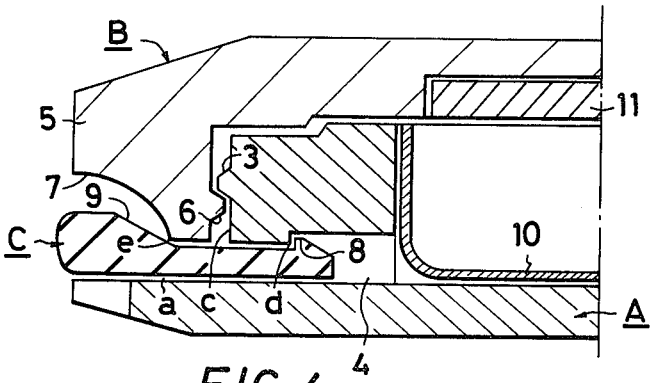
FIG. 3 is a side sectional view of FIG. 2.
Figure 4:
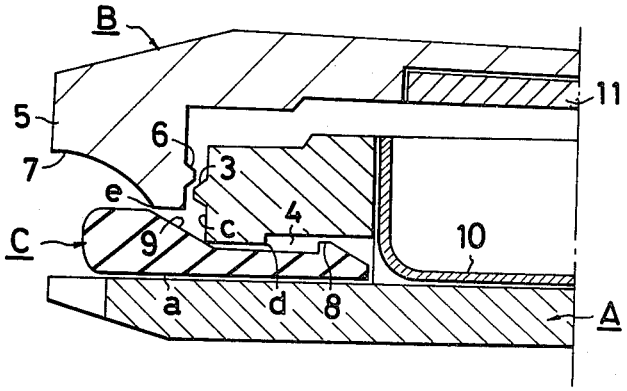
FIG. 4 is a side sectional view of the compact which shows the condition when the opening part is being opened.

Referring to the embodiment of the compact case of this invention, A is the case body and is connected with the lid body B so as to be able to open or to close freely through a hinge 1.

The upper side of the central opening of the body A is cut like the letter U. A box-like dent 2 is formed by a base a, both sides b and an inner side C, and a hook 3 is protruded on the upper portion of said inner side C. Further, at the lower part of said inner side C, a slide hole 4 is deeply perforated toward the inner side of the wall surface. The lower side of said slide hole 4 has the same surface as said base a, and on the upper side of said slide hole 4, a step part having a high inner side is formed.

Then, at an intermediate portion of the opening in the lid body B, a convex part 5 capable of being inserted into the dent 2 of said case body A is protruded, while at the inner side of said dent part 5 a hook b which engages with said hook 3 is protruded and at the lower part of the outer side in said convex part 5 an arc-like broken part 7 is provided.

Further, C is a slide member which is possible to slide along the base a of said case body A and said slide hole 4.

The top end part of said C has a height capable of being inserted into said slide hole 4 and is provided with a protuberance 8 which can be latched with the step of said slide hole 4.

Further, there is provided a taper 9 having a certain angle on the upper side in the head of said slide member C.

In Figures, 10 is a tray for preserve cosmetics, for example, face powder and 11 is a mirror.

When the compact in accordance with this invention is used, said compact is set up by forcibly inserting the slide member C into the slide hole 4 along the base a, while said slide member C is prevented from coming out of said slide hole 4 by means of the step d of hook 3 in said case body A and the protuberance 8 in said slide member C. In case of disengaging the hook 6 of lid body B with the hook 3 of case body A, the slide member C is allowed to slide toward the inner side of the slide hole 4 by pressing the head of said slide member C with a finger tip, while pushing up the lower side of the convex part 5 in the lid body B with the taper 9 of the slide member C, whereby the mesh of the hook 3 with the hook 6 can be automatically disengaged.

In addition, since it is possible to keep constant the opening size of the lid body B by means of the sliding distance of the end e in the arc-like broken part 7 along the taper 9 of said slide member c and the angle of taper 9, there causes a space between the lid body B and the case body A, whereby the lid body B can be easily opened.

The compact in accordance with this invention, as described above, is composed of perforating the slide hole along the base of the dent together with providing the convex part at the opening portion of the case body and being able to slide the slide member having the taper on the upper side thereof along the base and the slide hole.

Accordingly, when the slide member is pushed out, the lid body is pushed up by the taper of said slide member, whereby both hooks can be easily released.

I claim:

1. A compact comprising:

a case body (A) having tray means (10) therein for holding a substance;

a lid body (B);

hinge means (1) for interconnecting like edges of said case body and said lid body for pivotable movement between open and closed positions;

a box like dent (2) formed in an edge of said case body opposite the edge of said case body connected to said hinge means, said dent having a base (a), side walls (b) extending upwardly from the base and inwardly from the case body edge, and an inner wall (c) extending upwardly from the base and interconnecting inner edges of the side walls;

first hook means (3) protruding from an upper portion of said inner wall;

a slide hole (4) defined in and extending inwardly from a lower portion of said inner wall with the bottom of the slide hole being in the plane of the base;

latch means protruding downwardly from an edge of said lid body opposite the edge connected to said hinge means, said latch means having an inner surface with second hook means (6) protruding therefrom, said first and said second hook means being mutually engageable with each for releasably holding said case body and said lid body in the closed position, said latch means having an outer edge with a recessed lower portion (7) formed therein; and a slide member (C) having a leading end inserted into said hole, a lower surface slidable on said base, and an upper surface having a tapered portion extending downwardly from an outer portion to an inner portion of said slide member, said tapered portion being located in the recessed lower portion of said latch means when said first and said second hook means are engaged with each other and being movable into said dent so that a lower portion of said latch means is moved upwardly by said tapered portion to thereby disengage said first and said second hook means from each other.

2. A compact according to claim 1, wherein a leading portion of said leading end of said slide member has an upwardly extending protuberance (8) and wherein a wall of said case body defining an upper edge of said slide hole has a stepped portion (d) engageable by said protuberance to limit movement of said slide member out of said slide hole.

* * * * *